US005176473A

United States Patent [19]

Seegmiller

[11] Patent Number: 5,176,473

[45] Date of Patent: Jan. 5, 1993

[54] MINE ROOF TRUSS AND COMPONENTS

[76] Inventor: Ben L. Seegmiller, 143 South 400 East, Salt Lake City, Utah 84111

[21] Appl. No.: 864,333

[22] Filed: Apr. 6, 1992

[51] Int. Cl.[5] ..... E21D 20/00; E21D 21/00

[52] U.S. Cl. ..... 405/288; 405/259.5

[58] Field of Search ..... 405/288, 259.1-259.6, 405/303

[56] References Cited

U.S. PATENT DOCUMENTS

| | | | |
|---|---|---|---|
| 4,596,496 | 6/1986 | Tyrell et al. | 405/288 |
| 4,666,344 | 5/1987 | Seegmiller | 405/288 X |
| 4,749,310 | 6/1988 | White | 405/288 |
| 5,026,217 | 6/1991 | Seegmiller | 405/288 |

*Primary Examiner*—Dennis L. Taylor

*Attorney, Agent, or Firm*—M. Ralph Shaffer

[57] ABSTRACT

A mine roof truss and components thereof, the same including end support brackets, mine roof support plates, and associated structure. The truss structure is designed for maximum strength, and its mine roof support plates are designed for improving truss integrity and also for insuring that the stirrups used suitably preserve the integrity of the truss structure as well as provide safety features for stirrups to be placed under stress when such stirrups are loose or in a hanging position. The mine roof support plates utilized include depending horn portions having respective reaction surfaces for engaging stirrups to be placed in tension, and additionally, provide J-shaped lips forming cradles for the stirrups when the latter are in a hanging or loose position. In this way, the stirrups are preserved against dislodgement and free-fall within the mine which might contribute to a dangerous condition to workmen. The stirrups themselves are of hairpin configurement, having a cylinder welded at its sides to opposite end portions of the stirrups. In this way, maximum strength is preserved and, in addition, facility is provided for including within the stirrup elongate bars of the truss that are to be placed in tension.

13 Claims, 5 Drawing Sheets

MINE ROOF TRUSS AND COMPONENTS

FIELD OF THE INVENTION

The present invention relates to mine support trusses, and, more particularly, to trusses and components thereof, especially mine roof support plates, which are utilized within the constructon of the over-all truss structure so as to provide a tensioned truss disposed beneath and cooperating with the roof strata of a mine roof, and this in a safe manner should, for one reason or another, the truss inadvertently becomes slack and the stirrups of the truss slope downwardly.

BACKGROUND AND BRIEF DESCRIPTION OF PRIOR ART

In the past a number of different types of trusses have been devised, these being useful for supporting and placing in compression mine roof strata. This is accomplished through the tensioning of the roof truss provided in an appropriate manner. The present invention takes the approach of providing truss structure wherein the mine roof support plates interposed in the structure include a plate and, depending therefrom, plural horn portions, each having respective lower J-shaped lips and also a reaction surface for accommodating the stirrups utilized in the truss construction. The composite mine roof support plates, disposed generally intermediate the truss structure, will generally be case and have, for example, two, three or four depending horn portions with the respective J-shaped lips. The purpose of the lips is to provide cradles for the stirrups utilized, to be placed in tension in the truss, this for accommodating transport of each of the mine roof support plates and stirrups, the latter being suspended from the former by resting in such cradles formed by the J-shaped lips. The mine roof support plate includes an aperture for accommodating a roof bolt, this for securement to the mine strata in a conventional manner. Thereafter, the stirrups are elevated to essentially horizontal position to recieve the elongate bars of the truss to be placed in tension.

Certain prior patents are known, and one is the inventor's own patent entitled Mine Roof Support Truss and Components, Ser. No. 07-522,784 filed May 14, 1990 and issuing as U.S. Pat. No. 5,026,217 on Jun. 25, 1991. The invention herein, thus, can be incorporated, by way of example, in any of the following patent disclosures of the inventor's prior U.S. Pat. Nos. 4,666,344; 4,775,266; 4,776,729; 4,960,348. Other patents include U.S. Pat. No. 4,596,496 issued Jun. 24, 1986, U.S. Pat. No. 4,749,310 issued Jun. 7, 1988 and U.S. Pat. No. 4,934,873 issued Jun. 19, 1990. Relative to the latter patent, certain types of tensioning structure are known to include a stirrup-like object, standing alone. The latter however is believed to be designed of insufficient strength to accommodate high-tension trusses; furthermore, there is no art known, including consideration of the above-patents which teach mine roof trusses incorporating intermediate support plates wherein the mine roof support plates themselves are provided with reaction horns accommodating stressing of stirrups, the horns likewise being provided with cradles for preventing inadvertent dislodgement of the stirrups with the horn portions of the support plates during transit or otherwise.

BRIEF DESCRIPTION OF PRESENT INVENTION

According to the present invention, a mine roof truss is provided and comprises a series of components, including particular mine roof support plates, and also comprising stirrups and tie rods or other means for joining the stirrups in a tensioned manner; roof support end brackets are provided and are mutually spaced apart at the ends of the truss and secured by roof bolts mounted through the end brackets in an angulated manner to the roof strata. In the present invention, the intermediate roof support plates accommodating the stirrups utilized are of one piece, generally cast construction, the same including a mine roof bearing plate having a central mounting aperture and also two, three or four horn portions depending from such support plate and including lower J-shape upstanding lips and, elevated with respective said lips, reaction surfaces which retain the stirrups used in horizontal position when placed in tension. The horn portions are configured such that the stirrups can self-adjust under tension, either through angulated movement in a horizontal plane or be tilted slightly up and down, this to accommodate various truss configurements in accordance with mine roof surface contour.

In preferred form of the invention, these intermediate mine roof support plates have either a pair of diametrically opposite horn portions, four horn portions which are arranged in quadrature, and three horn portions which are triangularly arranged hereinafter described. There is a certain type of truss herein designed to prevent cutter roof failure proximate the intersection of the ribs with the mine roof; in such truss the intermediate mine roof support plates include angular depending protuberances or bosses provided with canted apertures, thereby providing for an angulated insertion therethrough of mine roof bolts which are to be anchored in angulated fasion in the roof strata over the ribs.

Thus, the depending horn portions include reaction surfaces for retaining stirrups engaged in the same in tension; additionally, the upturned lowered J-shaped lips accommodate easy transport of the stirrups when these intermediate support plates are transported insitu in position preparatory to anchoring. Furthermore, if there be a tendency of the mine roof to become deformed, producing slack in the truss, the stirrups will still not become dislodged and fall relative to the roof support plates. Rather, these will still be safely positioned above the working area by depending in whole or in part from the cradles formed by the J-shaped upturned lips associated with the horn portions.

Again, the upturned lip or lip portion of the horn portions of such support bracket provide not only for ease of transport of the necessary stirrups, preparatory to installation, but also serve as a safety feature to keep stirrups from becoming inadvertently disengaged with the mine roof support plates and chance droppage and injury to personnel therebeneath.

OBJECTS

Accordingly, a principle object of the present invention is to provide a new and improved mine support truss and components, particularly mine roof support plates to be used in intermediate points in the truss.

A further object is to provide improved mine roof support plates, usable in trusses, these designed for use with stirrups to be placed in tension.

A further object is to provide a series of two-way, three-way and four-way mine roof support plates, having two, three and four depending horn portions, respectively, wherein such horn portions accommodate interaction between the stirrups used, when placed in tension, and also providing a safety feature for both preventing dislodgement of stirrups from the respective horn portion as well as accommodating a carrying, by the horn portion of the plate, of stirrups when these are transported in situ preparatory to installation in a mine.

BRIEF DESCRIPTION OF DRAWINGS

The present invention, together with further objects and advantages thereof, may best be understood by reference to the following description, taken in conjunction with the following drawings in which:

FIG. 5 is an enlarged detail taken along the arcuate line 5—5 in FIG. 3.

DETAILED DESCRIPTION OF PREFERRED EMBODIMENTS

Figure 1:
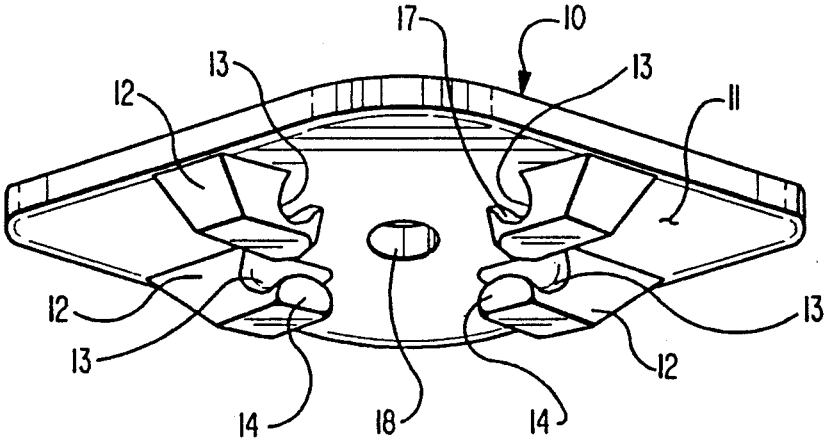
FIG. 1 is a perspective view on a flat, mine roof support plate including four depending horn portions mutually arranged in quadrature, the plate having a central securement aperture.

In FIG. 1 a mine roof support plate 10 has a bearing plate 11 and a series of depending horn portion 12 mutually arranged in quadrature and depending therefrom. Each of the depending horn portions include a reaction surface 13 and, beneath the same, a lower upturned J-shaped lip portion 14 disposed at least in part beneath at least a portion of reaction surface 13. The reaction surface 13 is configured to cooperate with the curved head portion 15 of a stirrup 16, the structure of which will be later described. At this point, it is important to note that a cradle 14 is formed by the J-shaped lip in conjunction with the reaction surface 13, the cradle being configured to support the stirrup 16, as hereinafter described, when the same is in a loose or hanging condition. Bearing plate 11 includes a central attachment aperture 18, intended for the insertion of a securing roof bolt as at 19 in FIG. 2.

In FIG. 1, where the mine roof support plate 10 includes four depending horn portions 12, the latter will assume a 90 degree relationship with the remaining horn portions, the same essentially being disposed in quadrature.

Figure 2:
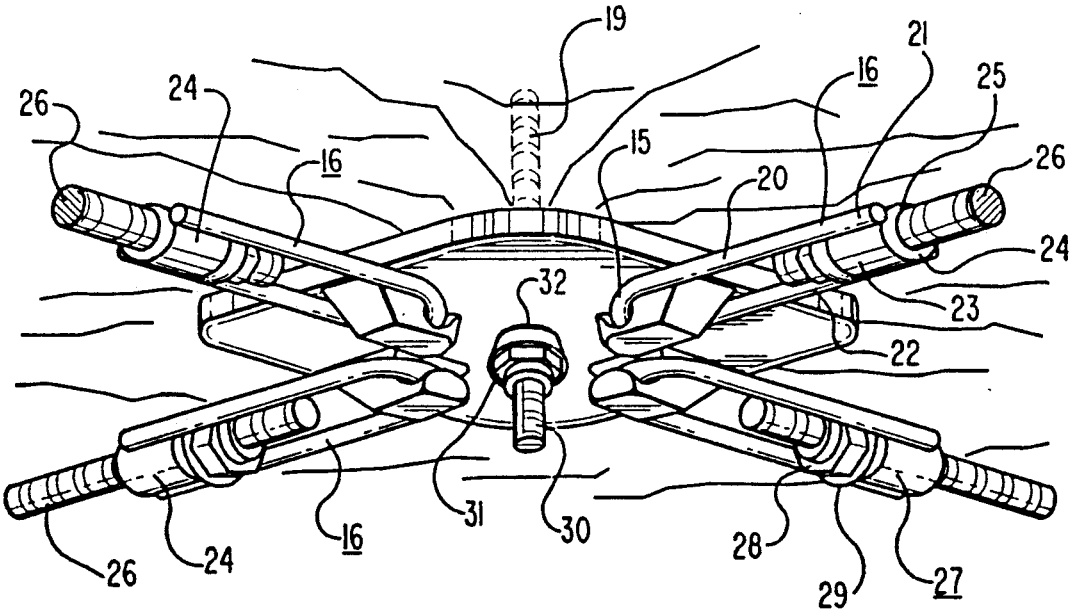
FIG. 2 is a view similar to FIG. 1 but illustrates the plate as being installed by a roof bolt and a series, i.e. four, stirrups being secured to respective ones of the depending horn portions, this illustrating installation not only of the mine roof support plate, disposed intermediate of the truss structure, but also of the stirrups in such structure, the latter accommodating tensioning bars.

In FIG. 2, each of the stirrups 16 is provided with a hairpin-shaped elongate element 20 that has the curved head portion 15 as well as opposite end portions 21 and 22. Joined as by welds to and between such end portions 21 and 22 is a member 23 generally taking the form of a cylinder 24 having an interior or central aperture 25. This central aperture receives a threaded tie rod 26 that is to be placed in tension by the tightening down of a spherically headed attachment nut 27. Nut 27 includes a wrench flat portion 28 and also a spherical boss or spherical portion 29 which is apertured to receive the threaded end of the tie rod.

Respective cylinders 24 are welded at opposite sides to the end portions 21 and 22, both top and bottom, relative to the hairpin shaped elongated element 20.

In FIG. 2 it is seen that the roof bolt 19, anchored in any conventional manner to the roof strata, is provided at its lower end 30, which is threaded, a reaction head or tightening nut 31, the latter being backed by washer 32.

FIGS. 1 and 2 thus illustrate the mine roof support plate 10 and also its securement in position against the roof surface of the mine roof and the incorporation thereof of the hairpin-shaped stirrups intended for positioning proximate the areas of cradle 17 to engage reaction surfaces 13 of the respective depending horn portions 12. The nuts 27 are tightened down so as to insure the placing in tension of the various tie rods 26.

Figure 3:
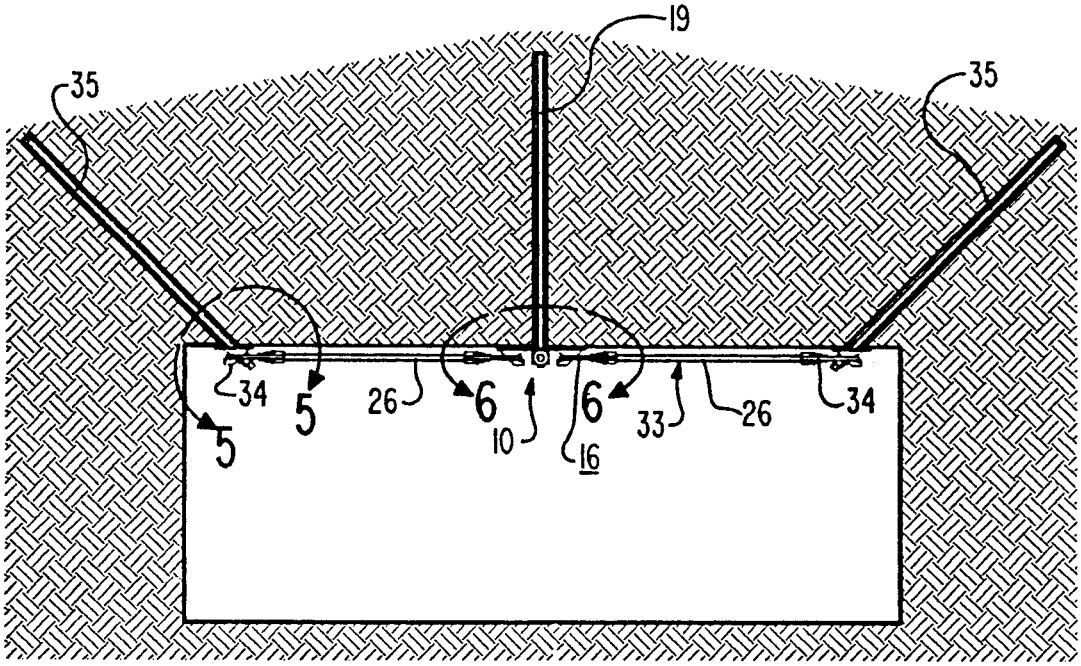
FIG. 3 is an end elevatoin of a mine opening showing the complete truss structure, the same having end brackets and angulated roof bolts, and also the intermediate mine roof support plate providing its securement roof bolt and the stirrups described.
Figure 4:
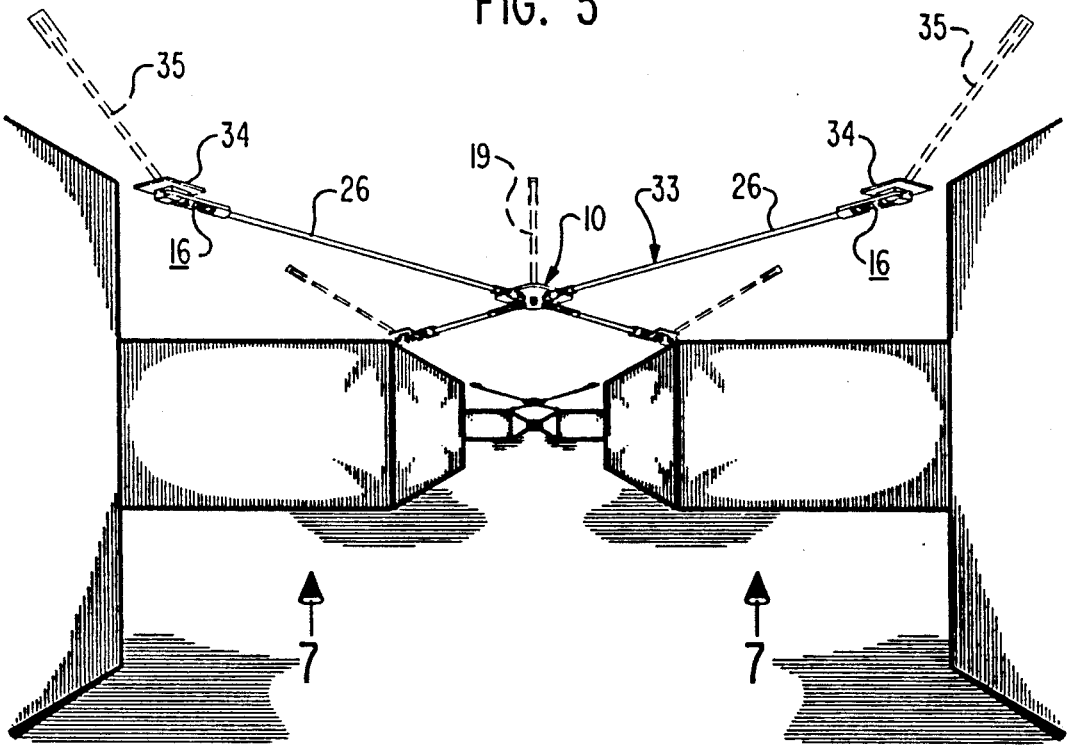
FIG. 4 is a perspective view illustrating, at a four-way passage within a mine, the securement of the truss having end brackets proximate rib intersections and also the center support plate including the depending horn portions aforementioned.

FIGS. 3 and 4 illustrate the incorporation of the structure of FIGS. 1 and 2 in a truss 33, the same being placed in position and secured by mine roof bolt 19 and, at opposite extremities, angulated mine roof bolts 35. Truss 33 as seen includes the centrally located mine roof support plate 10 and, in combination therewith, the four stirrups 16, tie rods 26, and end brackets 34 which engage the end stirrups 16 secured with respect thereto. End brackets may take the form of the brackets shown in the inventor's prior U.S. Pat. No. 5,026,217 which is fully incorporated herein by way of reference.

Thus, in an interior mine tunnel network at four-way openings, by way of example, a series of trusses 33 may be installed as illustrated in FIG. 4.

Figure 5:
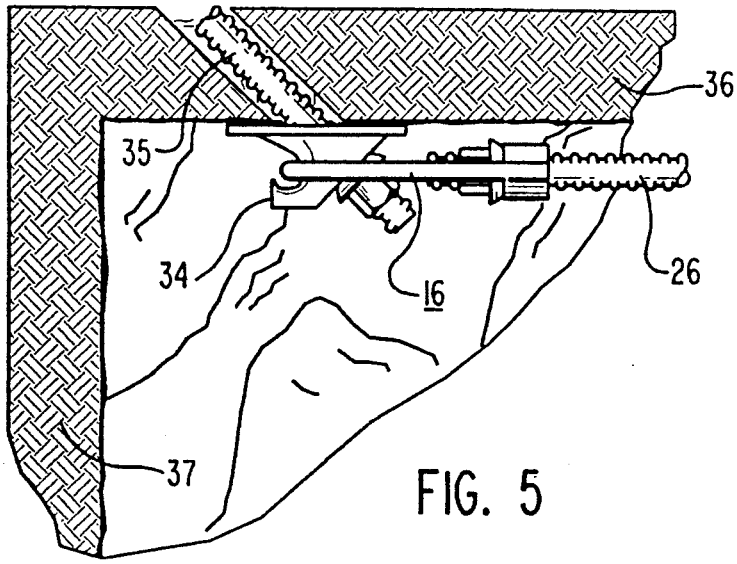
FIG. 5 is an enlarged fragmentary detail, principally in section, illustrating an end bracket in the truss, being secured in place by an angulated roof bolt, the end bracket accommodating a stirrup which itself retains the end protuberance of a tie rod to be placed in tension.

FIG. 5 further serves to illustrate the incorporation and mounting of a respective end bracket 34, this preferably taking the form of that shown in the inventor's prior patent above-referenced. Of course, a variety of end brackets can be used as are known in the prior art; however, the one illustrated is very much preferred, especially in veiw of the fact that there is likewise a support cradle 17 for supporting stirrup 16 when the same is in a hanging position.

Figure 6:
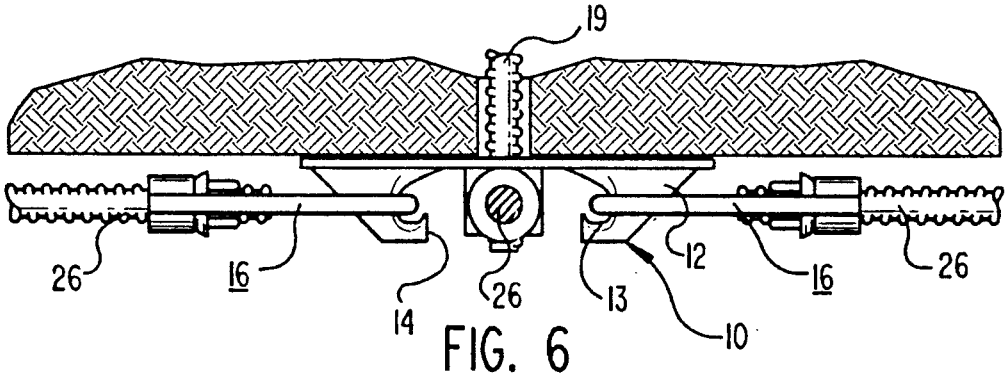
FIG. 6 is an enlarged fragmentary detail taken along the arcuate line 6—6, illustrating the intermediate mine roof support plate, its anchoring to the mine roof and the engagement of the horn portions thereof by stirrups of the tensioned truss structure.
Figure 7:
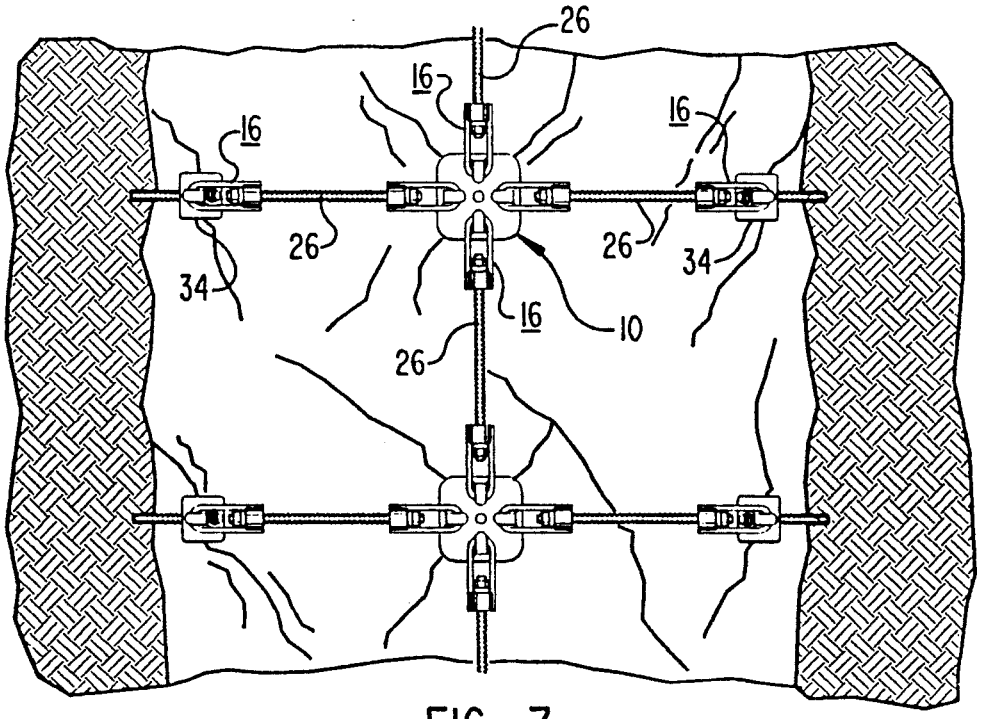
FIG. 7 is a bottom plan looking up of a mine roof, is taken along the arrow 7—7 in FIG. 4, and shows the truss structure as being secured together by the tie rods and stirrups aforementioned, the stirrups themselves being secured to the depending horn portions of the intermediate mine roof support plates utilized.

FIG. 6 and 7 illustrate that the mine roof support plates and truss can be incorporated in elongated mine passage way in a continuous rectilinear pattern, this to truss a substantial span both lengthwise and widthwise of an exposed mine roof. In essentially all applications, of course, the mine roof bolts 35 as seen in FIG. 5 will be disposed at an angle through the mine roof strata at 36; in the embodiment shown in FIG. 5, the end brackets will be disposed proximate the intersection the mine roof to the mine ribs 37 of the mine passage way.

Figure 8:
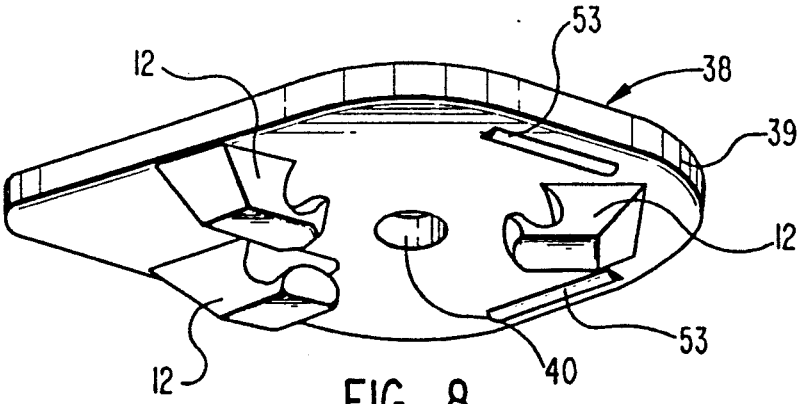
FIG. 8 illustrates in perspective view an alternate mine roof support plate for three-way constructions wherein the depending horn portions are three in number relative to the flat bearing plate provided.

FIG. 8 illustrates a mine roof support plate 38 for three-way systems, which includes a bearing plate 39 and also, depending therefrom, the horn portions 12 that have been hitherto discussed. This time the horn portions 12 are preferably arranged such that the ones on the left hand side of the drawing are disposed 90 degrees apart, with the remaining horn portion 12 on the right hand side of the drawing resting essentally upon a diagonal line connecting alternate rounded corners of plate 39. It is seen that the plate can be installed, see FIG. 10, either centrally, relative to the opening, or, and preferably, closer to the leg of the tee of the passageway pattern, this to insure that maximum support is made at a region most likely to fail, absent the inclusion of the truss.

Figure 10:
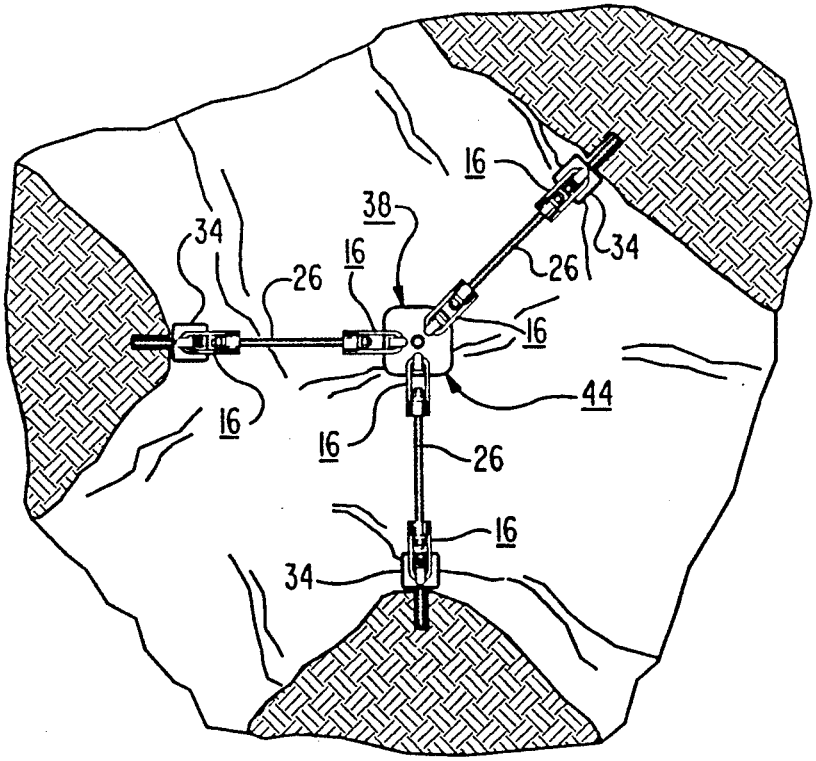
FIG. 10 is a bottom plan of a three-way mine opening wherein adjacent to the roof there is mounted a truss incorporating the three-way support plate of FIG. 8.

Thus, FIGS. 8 and 10 illustrate the configuration of the three-way mine roof support plate and also its truss 44, as seen in FIG. 10, which will include the central plate as well as end brackets 34, the several stirrups 16, tie rods 26 with their securement nuts, and so forth.

Figure 9:
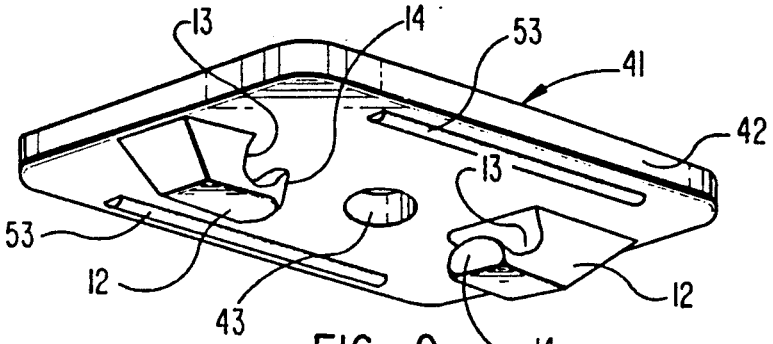
FIG. 9 is similar to but is differentiated from the structure shown in FIGS. 1 and 8 in that, in the perspective view indicated in FIG. 9, the mine roof support plate has a pair of diametrically opposed depending horn portions.

In FIG. 9, a two-way mine roof support plate is seen, the same being identified by the numeral 41 and having bearing plate 42 with diametrically opposed and mutually facing horn portions 12. It is seen that the inner reaction surfaces 13 face each other as well as the upstanding J-shaped lips at 14.

Figure 11:
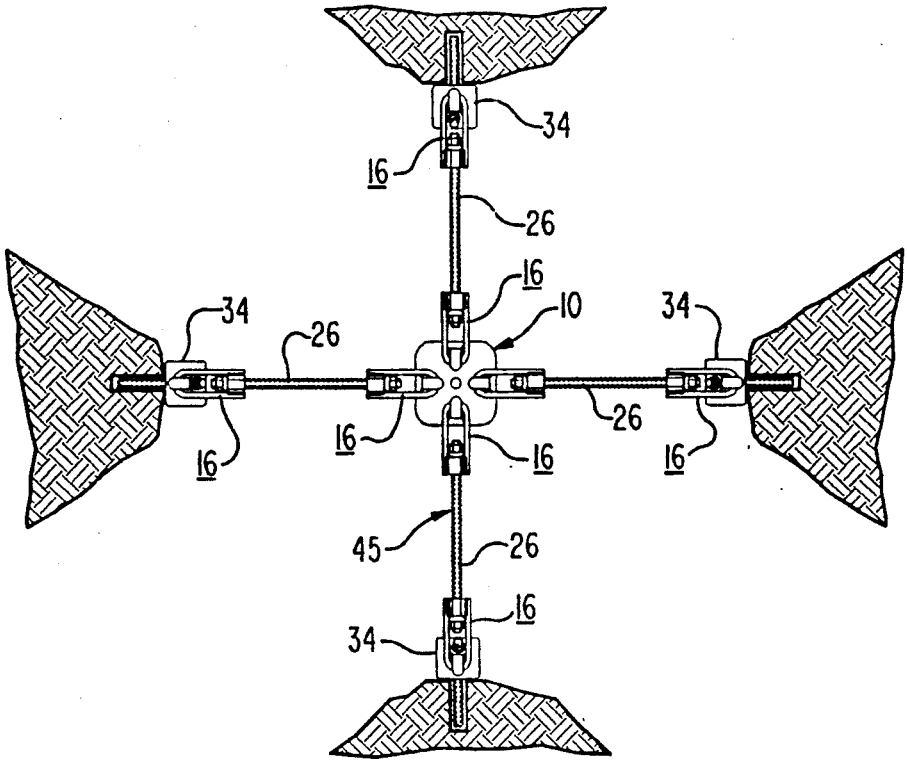
FIG. 11 is a bottom plan illustrating the truss constituting a four-way truss having an intermediate mine roof support plate constituted by the plate of FIG. 1.

FIG. 11 illustrates yet another type of truss, truss 45, which is essentially similar to that seen in FIG. 4, but which is employed for a similar but perhaps slightly different mine passage way configuration. At all events, the mine roof support plate 10 is anchored in position as seen in FIG. 2 and will include all of the essential elements as identified in FIG. 11 as well as in the prior drawings relative to elements having the same numeral indications.

Figure 12:
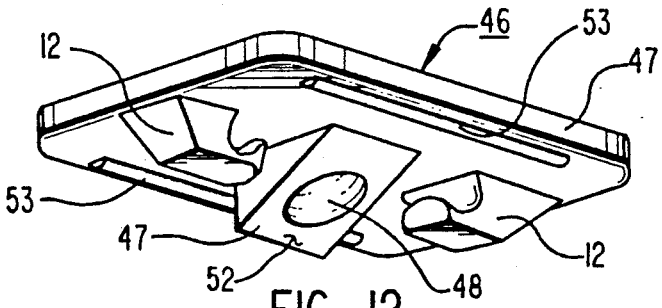
FIG. 12 illustrates a modified mine roof support plate, is similar to FIG. 9 but this time includes a depending boss or protuberance which includes an angulated aperture passing through the plate, whereby to accommodate a mine roof bolt.
Figure 13:
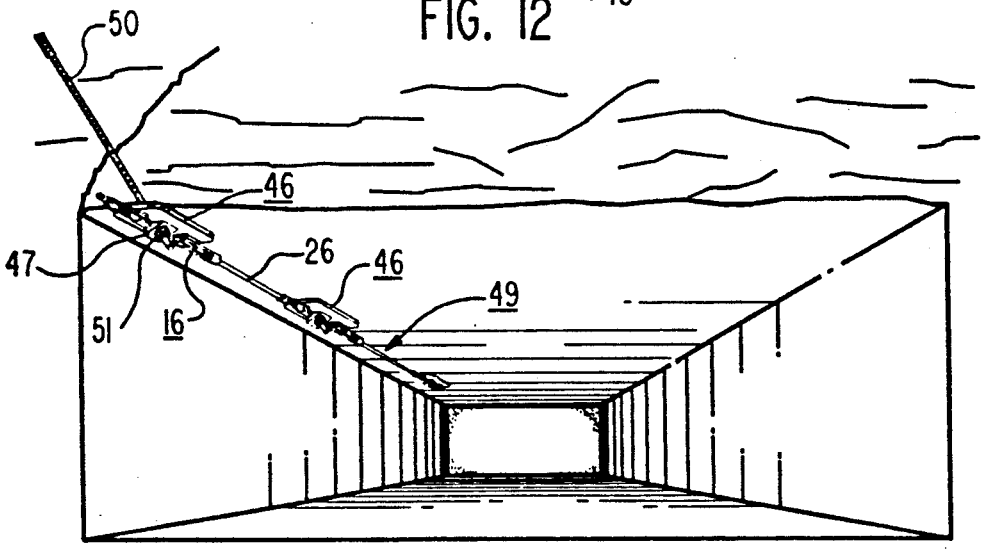
FIG. 13 illustrates a mine tunnel wherein, for cutter roof control, the plates of FIG. 12 are used in the overall parallel truss structure and are secured in position by angulated roof bolts as indicated in FIG. 13.

FIGS. 12 and 13 illustrate another type of mine roof support plates and associated truss. In FIG. 12, mine roof support plates 46 includes a bearing plate 47 and, depending therefrom, horn portions 12 as illustrated and which are at opposed positions and positioned at opposite sides of the plate. Intermediate the horn portions 12 is a depending angular boss or protuberance 47 provided with canted aperture 48. The structure seen in FIG. 12 is employed in the truss 49 in FIG. 13 which is intended for use at mine roof areas which are jeopardy as to cutter roof failure proximate the juncture of the roof and the side-wall ribs. Truss 49 will include the tie rods 26 and stirrups 16, hereinbefore fully described, with the mine roof support plates 46 being secured in place by respective angulated mine roof bolts 50 which are tightened by nuts 51 bearing against the reaction surface 52 of boss 47. Accordingly, the mine roof support plates accommodates the tensioning structure, including the tie rods 46 and stirrup 16 and, in addition, the secured mounting of the support plates to the mine roof structure.

In all of the embodiments, it is preferred that the various mine roof support plates and brackets have a bearing plate in excess of ½" thick or thicker and be cast appropriately. The several horn portions 12 seen in the various embodiments are preferably rounded as to horizontal dimension and configured so as to accommodate the angular movement, in a horizontal plane and also in a vertical plane, of the several stirrups, this to accommodate the possibly non-planar configurement of the roof as well as different levels at which the end corner brackets are mounted. Greater flexibility is insured where the reaction surfaces are rounded rather than flat and extend vertically a dimension considerably greater than the thickness of the stirrup. This is clearly seen in FIG. 5 and also FIG. 2 as well as FIG. 6, given by way of example. Relative to the structure shown in FIG. 6, this will apply for any trusses utilizing the mine roof support plate 41 seen in FIG. 9 as well as the support plate of FIGS. 1 and 2, merely by way of example.

The castings may include stiffener portions 53 as seen in FIGS. 8, 9, and 12, for example, and where desired, to increase strength.

In all of the embodiments, see for example FIGS. 1 and 2, the reaction surfaces 13 and upturned J-shaped lips 14 of the horn portions 12 are mutually inwardly facing. The corresponding reaction surface and upturned J-shaped lip of a respective end bracket 34, see FIG. 5, are outwardly facing. Stirrup cylinders or members 24 comprise reaction portions of the respective stirrups for coacting with tensioning securement nuts 27 threaded onto opposite threaded ends of the tie rods 26, for tensioning the tie rods, stirrups, and over-all truss structure.

Accordingly, what are provided herein are a series of trusses which are utilized for a variety of mine roof installations and which incorporate end brackets and, especially, mine roof support plates, this in a manner as to preserve truss integrity as well make provision for the tensioned stirrups whether the same be in hanging position, during the installation and transport processes, or whether the same be installed. Furthermore, any loosening of the truss, though such is not anticipated, would still deter if not prevent completely the disengagement of the stirrups from their horn portions and hence from the support plates, this to preserve truss integrity and to prevent a dropping down of truss objects so as to endanger workmen there beneath.

While particular embodiments of the present invention have been shown and described, it will be obvious to those skilled in the art that various changes and modifications may be made without departing of the material aspects of the invention and, therefore, the aim of the appended claims is to cover all such changes and modifications as fall within the true spirit and scope of the invention.

I claim:

1. A mine roof support plate for a mine truss and including, in combination, a plate having an upper bearing surface for engaging an exposed mine roof surface, and plural mutually spaced horn portions depending from and forming part of said plate, each of said horn portions being provided with a lower, vertically raised, J-shaped lip means forming an upwardly facing stirrup-support cradle for preserving truss integrity and supporting a respective external stirrup in hanging position in said cradle in non-tensioned condition, said plate being provided with a transverse securement aperture, and each of said horn portions having a transversely curved reaction surface elevated with respect to said cradle and cooperable with said respective external stirrup.

2. The structure of claim 1 wherein said horn portions comprise a pair of mutually opposite horn portions mutually spaced from said aperture and having their reaction surfaces mutually inwardly positioned and their lip portions mutually inwardly extending therefrom.

3. The structure of claim 1 wherein said horn portions comprise four horn portions mutually spaced from said aperture and mutually arranged in quadrature, with their reaction surfaces and lip portions extending mutually inwardly.

4. The structure of claim 1 wherein said horn portions are three in number, mutually spaced with respect to said aperture, and having their reaction surfaces and lip portions mutually inwardly positioned.

5. The structure of claim 1 wherein said horn portions are two in number, mutually oppositely positioned on said plate, said plate having, interposed between said horn portions, a depending angular boss provided a canted mine-bolt-head reaction surface, said aperture being likewise canted and passing through said plate, said angular boss and said mine-bolt-head reaction surface.

6. The structure of claim 4 wherein said plate is essentially square, two of said horn portions being in ninety degree relation and mutually spaced and oriented relative to a diagonal line passing through opposite corners of said plate, the third of said horn portions being essentially positioned upon and aligned with said diagonal line.

7. A mine roof support plate for a mine truss and including, in combination, a plate having an upper bearing surface for engaging an exposed mine roof surface, and mutually spaced horn portions depending from and part of said plate, each of said horn portions being provided with a lower, vertically raised, J-shaped lip means forming an upwardly facing stirrup-support cradle for preserving truss integrity and supporting an external stirrup in hanging position in said cradle in non-tensioned condition, said plate being provided with a transverse securement aperture, and each of said horn portions having a reaction surface essentially facing each other, elevated with respect to said cradle, and cooperable with said external stirrup.

8. In combination, plural mine truss stirrups each having a hairpin shaped elongate element provided a curved head portion and having opposite ends and a cylinder integral with and disposed between said opposite ends and provided with a central aperture admitting an external elongate truss element to be placed in tension; and a mine roof support plate for a mine truss and including a plate having an upper bearing surface for engaging an exposed mine roof surface, and mutually spaced horn portions depending from and forming part of said plate, each of said horn portions being provided with a lower, vertically raised, J-shaped lip means forming an upwardly facing stirrup-support cradle for preserving truss integrity and supporting a respective one of said stirrups in hanging position when in said cradle in non-tensioned condition, said plate being provided with a transverse securement aperture, and each of said horn portions having an inwardly oriented, transversely curved reaction surface elevated with respect to said cradle and engaged by respective ones of said external stirrups.

9. The structure of claim 8 wherein said horn portions are so dimensioned and configured as to permit adjustable movement of respective ones of said stirrups as to sideways and up-and-down movements.

10. A mine roof support truss including, in combination, end brackets provided with angulated attachment apertures, roof bolts passing through said apertures for securing said end brackets in place, trussing structure secured to and between said end brackets, said trussing structure including an intermediate plate provided an attachment aperture, a roof bolt passing through said attachment aperture, said plate being provided with depending horn portions having respective, inwardly facing reaction surfaces and lower, mutually inwardly oriented, raised J-shaped lips, said trussing structure also including elongated, hairpin shaped stirrups coupled to said end brackets and retentively engaged by said horn portions, respectively, at their reaction surfaces.

11. The structure according to claim 10 wherein said trussing structure includes elongate tensioning bars passing into and secured by said stirrups.

12. The structure of claim 11 wherein said stirrups each include a hairpin shaped elongated element having a curved head portion engaging a respective horn portion and also a pair of side opposite ends, and a cylinder provided a central aperture and secured to and between said side opposite ends, said tensioning bars respectively passing through said cylinders and having respective protruberances engaging respective inner ends of respective ones of said cylinders.

13. A mine roof support truss including, in combination, plural end brackets each having a depending horn portion provided with a canted mounting aperture and an outwardly oriented reaction surface terminating in a lower, outwardly oriented, raised J-shaped lip forming with said reaction surface a stirrup-support cradle; an intermediate support plate having a mounting aperture and provided with mutually spaced, depending horn portions provided with mutually inwardly disposed reaction surfaces and lower, likewise mutually inwardly disposed J-shaped lips forming with respective ones of said reaction surfaces stirrup-supporting cradles; a mine roof anchor bolt passing through said mounting aperture for anchoring said plate to mine roof strata; a first series of stirrups having reaction portions and looped over said horn portions of said end brackets; a second series of stirrups having reaction portions and looped over said horn portions of said intermediate support plate; tie rods respectively passing through said reaction portions of respective ones of said first and second series of stirrups, and securement means engaging said tie rods and coacting with said reaction portions for tensioning said tie rods and, thereby, said stirrups and truss.

* * * * *